United States Patent [19]

Ewbank et al.

[11] Patent Number: 4,709,665

[45] Date of Patent: Dec. 1, 1987

[54] HIGH TEMPERATURE VIBRATION ISOLATING MOUNT

[75] Inventors: Michael E. Ewbank, Rockford; Henry F. Johnson, Rockton, both of Ill.

[73] Assignee: Sundstrand Corporation, Rockford, Ill.

[21] Appl. No.: 944,760

[22] Filed: Dec. 22, 1986

[51] Int. Cl.[4] ..... F22B 37/24

[52] U.S. Cl. ..... 122/510; 114/20.1; 122/504; 165/69

[58] Field of Search ..... 122/504, 510; 165/69, 165/162; 114/20.1

[56] References Cited

U.S. PATENT DOCUMENTS

| | | | |
|---|---|---|---|
| 3,145,678 | 8/1964 | Shmorhun et al. . | |
| 4,259,521 | 10/1981 | Sommars | 165/69 |
| 4,403,762 | 9/1983 | Cogswell, II et al. . | |
| 4,653,576 | 3/1987 | Lagally | 165/69 |

*Primary Examiner*—Edward G. Favors

*Attorney, Agent, or Firm*—Wood, Dalton, Phillips, Mason & Rowe

[57] ABSTRACT

Thermal degredation of elastomeric pads (74, 76) in a vibration isolating mount (40) intended for use in a high temperature environment such as posed by a boiler (26) is avoided with a construction including an inner annular element (42) secured to the boiler (26) and having an axial face (52) directed toward the boiler (26), an intermediate annular element having a face (72) facing, but axially spaced from the face (52) and radial projections (64) extending radially outwardly of the periphery of the element (42). An outer element (54) has portions (55) aligned with the projections (64). Elastomeric pads (74) extend between the intermediate and the outer elements while pads (76) extend between the intermediate and inner elements with the intermediate elements shading the pads (74, 76) from radiant energy emanating from the boiler (26).

9 Claims, 3 Drawing Figures

FIG. 2
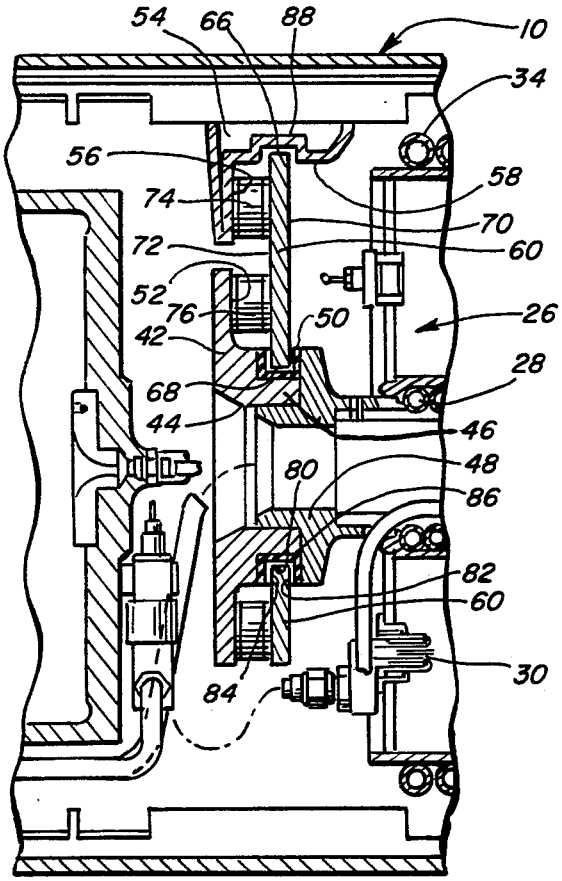
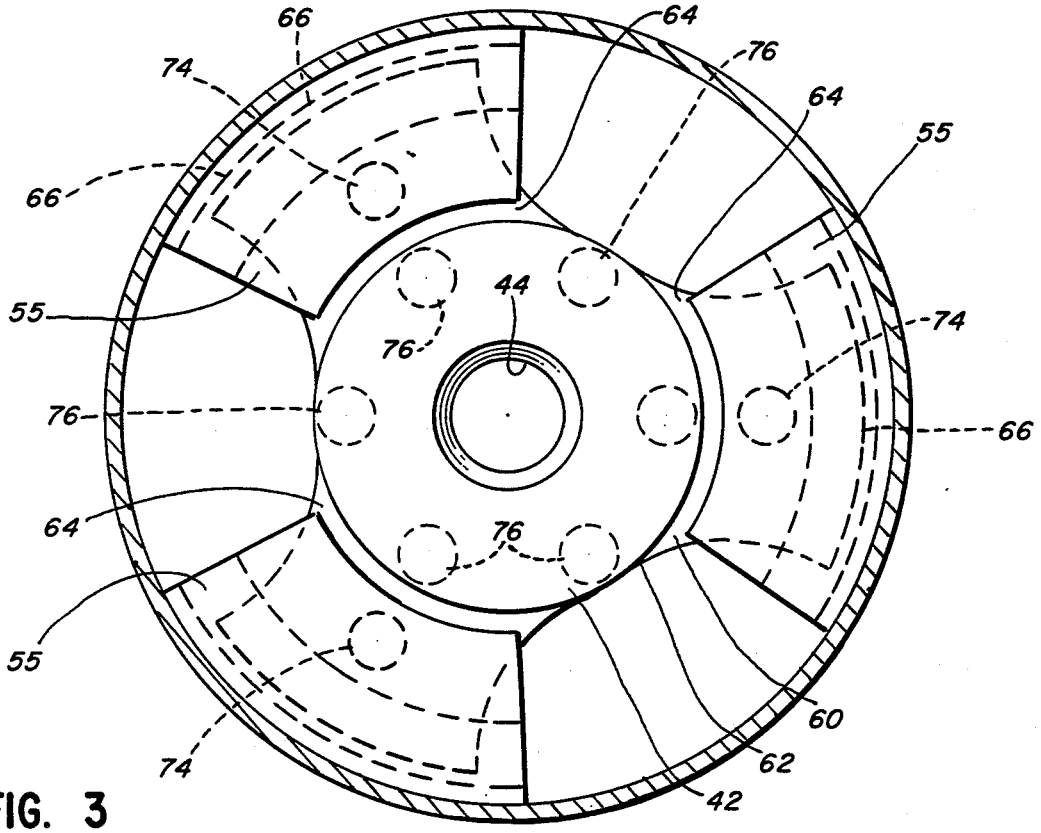
FIG. 3

HIGH TEMPERATURE VIBRATION ISOLATING MOUNT

FIELD OF THE INVENTION

This invention relates to vibration isolating mounts, and more particularly, to a vibration isolating mount especially adapted for use in high temperature environments whereat it is exposed to substantial radiant energy.

BACKGROUND OF THE INVENTION

Naval torpedoes must operate extremely quietly to prevent detection and possible destruction as a result of such detection. Consequently, every effort is made to minimize or eliminate sources of noise in such torpedoes.

At the same time, propulsion systems for naval torpedoes have what may be termed a high energy density in order to maximize torpedo capability. The high energy density is achieved by utilizing highly reactive components in an oxidation reaction which rapidly vaporizes a working fluid such as water to in turn drive a turbine. Not infrequently, components such as lithium and sulfur hexafluoride are utilized and combusted in a boiler. The resulting oxidation reaction proceeds at a very high temperature and generally at a rapid rate. As a consequence, the vaporization of the working fluid and the resulting passage of the vapor through boiler flow paths can generate substantial vibration within the boiler. Such vibration, if not isolated, would be readily detectable as noise when the torpedo is in operation, which, of course, is undesirable as mentioned above.

Consequently, it is desirable to vibrationally isolate the boiler from the torpedo hull to prevent detectable noise from passing from the hull into the water into which the torpedo is running. However, because of the high temperature environment resulting from the oxidation reaction occurring within the boiler, as well as special constraints imposed by the obvious desirabiity of minimizing the size of the torpedo, long-lived vibration isolation systems that occupy a minimum of space have not been readily achievable.

The present invention is directed to overcoming the above problem.

SUMMARY OF THE INVENTION

It is the principal object of the invention to provide a new and improved vibration isolating mounting system for use in a high temperature environment. More particularly, it is an object of the invention to provide such a vibration isolating mount where temperature degradable components of the mount are shielded from energy in the environment in which the mount is used and wherein the mount is extremely compact.

An exemplary embodiment of the invention achieves the foregoing object in a vibration isolating mount including a first element adapted to be connected to a source of radiant energy and having a side adapted to face such source. A first elastomeric pad is secured to the side of the first element and a second element is adapted to be secured to a base and spaced from the first element sufficiently so as to be in non contacting relation therewith. The second element has a side also adapted to face the source. A second elastomeric pad is secured to the thus defined side of the second element. An intermediate element has a first side facing the source and a second side facing the above mentioned sides of the first and second elements in a space from both said elements sufficiently so as to be in non contacting relation therewith. The second side of the intermediate element is secured to the pads so that the intermediate element and the first side thereof is interposed between the source and the pads to shade the pads from radiant energy from the source.

In a preferred embodiment, the elements are annular and the second element is radially outwardly of the first element.

A highly preferred embodiment contemplates that the intermediate element have radially inner and outer edges with the first element having a radially outwardly opening groove and the second element having a radially inwardly opening groove. Those grooves loosely receive respectively the radially inner and radially outer edges of the intermediate element to thereby act as snubbers to arrest movement of the intermediate element in excess of a predetermined amount.

A highly preferred embodiment contemplates that the grooves are provided with bottom walls serving to arrest excess radial movement and opposed side walls serving to arrest excess axial movement.

The invention also contemplates a lining of the grooves with an elastomeric material.

The invention also contemplates a system incorporating the mount. The system includes a high temperature boiler connected to the first mentioned side of the first element to thereby constitute the source of radiant energy.

Other objects and advantages will become apparent from the following specification taken in connection with the accompanying drawings.

DESCRIPTION OF THE DRAWINGS

FIG. 2 is an enlarged, fragmentary sectional view illustrating the vibration isolating mount and torpedo components in the immediate environs thereof;

FIG. 3 is an enlarged sectional view taken approximately along the line 3—3 in FIG. 1.

DESCRIPTION OF THE PREFERRED EMBODIMENT

Figure 1:
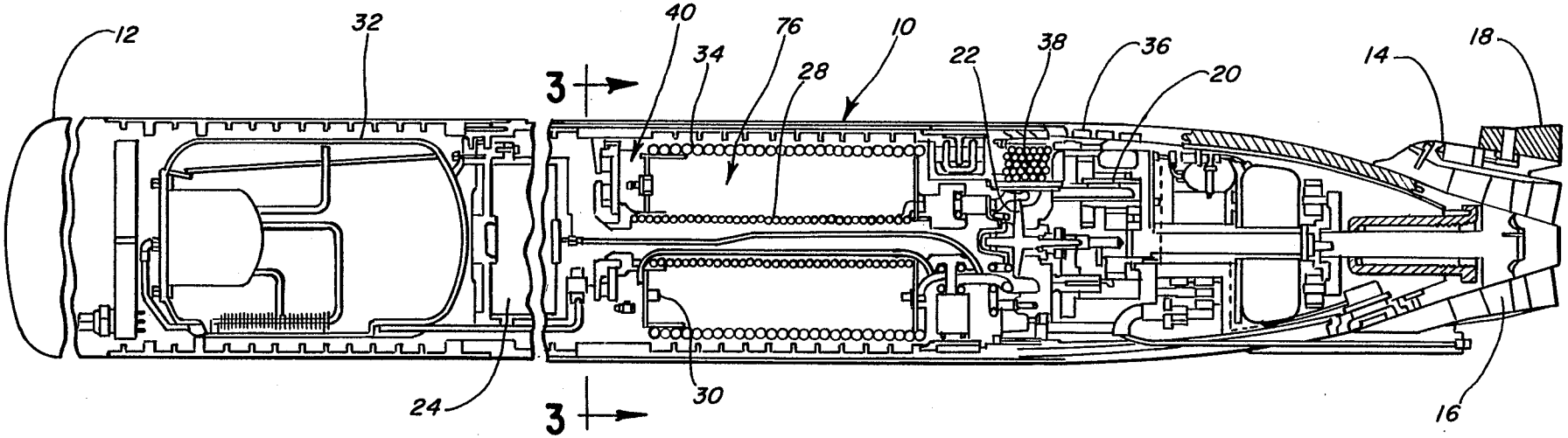
FIG. 1 is a sectional view of a torpedo embodying a vibration isolating mount made according to the invention.

A typical environment in which a vibration isolating mount for use in a high temperature environment may be employed is illustrated in FIG. 1 in the form of a naval torpedo. However, it is to be understood that the vibration isolating mount of the invention may be utilized in a large variety of other environments and that no limitation as to use in a torpedo is intended except insofar as set forth in the appended claims.

The torpedo includes a hull, generally designated 10, including a forward end 12 and a rearward end 14. The rearward end 14 may be provided with a propulsor 16 of any known type as well as direction control devices 18. The propulsor 16 typically will be connected to the output of a transmission 20 which in turn is driven by a turbine wheel 22. Working fluid in the form of water is contained in a water reservoir 24 within the hull until the torpedo is to be operated. When that occurs, by any suitable means as, for example, the application of pressure to the interior of the reservoir 24, the water is directed into a boiler generally designated 26, and in particular, to an interior coiled conduit 28 thereof. The boiler 26 contains metallic lithium (not shown) and includes one or more nozzles 30 connected to an oxidant reservoir 32 within the hull 10. Typically, the reservoir 32 will contain sulfur hexafluoride.

In any event, oxidation of metallic lithium by the sulfur hexafluoride will occur within the boiler 26 and water within the inner coil 28 will be vaporized as it flows therefrom to an outer coil 34. From the outer coil 34, the water vapor or steam will be directed by suitable piping to the turbine wheel 22 to drive the same.

Typically, the system will be a closed cycle Rankine cycle system including a hull condenser 36, a regenerator 38 and a condensate pump (not shown).

In order to prevent transmission of noises generated as a result of occurrences in the boiler 26 to the hull 10, one or both ends of the boiler 26 is provided with a vibration isolating mount as, for example, generally shown at 40.

Turning now to FIGS. 2 and 3, the details of the vibration isolating mount 40 are shown in greater detail.

The mount includes a first annular element 42 which is generally donut shaped and includes a central aperture 44. As seen in FIG. 2, the element 42 has an axially extending sleeve 46 suitably fitted on a sleeve 48 secured to the boiler 26 by any suitable means. The sleeve 46 and 48 define a radially outwardly opening groove 50 for purposes to be seen.

The first element 42 also includes a first side or surface 52 which faces the boiler 26 which, in turn, when the torpedo is operating, constitutes a source of radiant energy. Typically, the first element 42 will be formed of metal or the like.

A second element 54 is suitably mounted to the hull 10. In actuality the element 54 may be made up of three separate portions 55 as best seen in FIG. 3. Each includes a surface or face 56 which is nominally coplaner with the surface 52 on the first element 42 and likewise faces the boiler 26. The second element 54 also includes a radially inwardly opening groove 58 for purposes to be seen. Typically, the second element 54 is formed of metal or the like and can be ascertained from both FIGS. 2 and 3, the same is disposed radially outwardly of and spaced from the first element 42.

The system also includes an intermediate element 60. As best seen in FIG. 3, the intermediate element 60 includes a generally circular radially inner section 62 from which three projections 64 extend in the radially outward direction. The number of the projections 64 and the location thereof corresponds to the number of the portions 55 of the second element 54.

It will be observed from FIG. 2 that a radially outer edge 66 of each of the projections 64 is loosely and freely received within the groove 58 and the second element 54 while a radially inner edge 68 of the intermediate element 60 is received loosely and freely within the groove 50.

The intermediate element 60 includes a first side 70 facing the boiler 26 and a second side 72 facing the sides 52 and 56 of the first and second elements 42 and 54 respectively.

A first set of elastomeric pads 74 interconnect the sides 56 and 72 at the locations illustrated in FIG. 3 while a second set of similar pads 76 interconnect the sides 52 and 72 at the locations likewise illustrated in FIG. 3.

Thus, it will be appreciated that a two-stage vibration isolating mount is defined. Preferably, in order to maximize isolation, the intermediate element 60, which comprises the intermediate mass of the vibration isolating system, is a relatively large mass.

The construction just described serves to protect the pads 74 and 76 from thermal degredation in the high temperature environment surrounding the boiler 26. In particular, the intermediate element 60 is sized to extend both radially outwardly and radially inwardly of the location of the pads 74 and 76 as can be seen in FIG. 2. Thus, its surface 70 intercepts radiant energy emanating from the boiler 26 to shade the pads 74 and 76 from such radiant energy, subjecting the pads 74 and 76 only to that which flows thereto via conduction. As a result, the pads 74 and 76 are adequately protected.

As can be seen in FIG. 2, each of the grooves 50 and 58 includes a bottom wall 80 flanked by two opposed side walls 82 and 84. The walls 80, 82 and 84 act as snubbers to prevent excessive movement of the various components with relation to each other. In particular, the radially inner edge 68 of the intermediate mass 60 may bottom out against the bottom 80 of the groove 50 to limit radial movement and may abut either one of the opposed side walls 82 or 84 to limit axial movement. Similar action between the outer edge 66 of the intermediate element 60 and the side and bottom walls of the groove 58 will likewise occur.

Preferably, each of the grooves 50 and 58 is lined with a U-shaped in cross section insert 86 and 88 respectively which are normally spaced from the associated edge 66 or 68 of the intermediate element 60. This insert is made of an elastomeric material and serves to prevent metal to metal contact when snubbing action occurs, which contact would generate undesirable noise. It is desirable that the inserts 86 and 88 be located within the grooves 50 and 58 as opposed to being disposed on the edges 66 or 68 of the intermediate mass 60 since the metal walls of the grooves 50 amd 58 likewise tend to shade the inserts from radiant energy emanating from the boiler 26 and thus extend their life.

From the foregoing, it will be appreciated that a vibration isolating mount made according to the invention has a number of advantages. For one, the invention provides a two-stage vibration isolating mount and, as is known, a two-stage isolation system increases the attenuation of high frequency vibrations. In addition, the construction of the invention is extremely axially compact, a highly desirable feature in many applications where space constraints are present.

Furthermore, the unique location of the intermediate mass 60 between the source of radiant energy to which the first element 42 is to be mounted to act as a shade for the elastomeric pads 74 and 76 assures long life to minimize the possibility of failure during operation of the torpedo. And where torpedoes are utilized for practice purposes, the additional life provided by a vibration isolating mount made according to the invention simplifies operations that must be performed on the torpedo before it may be reused in practice, thereby providing a substantial cost savings.

We claim:

1. A vibration isolating mount for use in high temperature environments comprising:

a first element adapted to be connected to a source of radiant energy, said first element having a side adapted to face said source;

a first elastomeric pad secured to said side of said first element;

a second element adapted to be secured to a base and spaced from said first element sufficiently to be in non contacting relation therewith, said second element having a side adapted to face said source;

a second elastomeric pad secured to said side of said second element; and an intermediate element having a first side facing said source and a second side facing said sides of said first and second elements and being spaced from both said elements sufficiently to be in non contacting relation therewith, said second side being secured to said pads so that said intermediate element and the first side thereof are interposed between said source and said pads to shade said pads from radiant energy from said source.

2. The mount of claim 1 wherein said elements are annular and said second element is radially outwardly of said first element.

3. The mount of claim 2 wherein said intermediate element has radially inner and outer edges, said first element has a radially outwardly opening groove loosely receiving said radially inner edge and said second element has a radially inwardly opening groove loosely receiving said radially outer edge, said grooves thereby acting as snubbers to arrest movement of said intermediate element in excess of a predetermined amount.

4. The mount of claim 3 wherein said grooves have bottom walls and opposed side walls, said side walls serving to arrest axial movement and said bottom walls serving to arrest radial movement.

5. The mount of claim 1 and further including a high temperature boiler connected to said side of said first element to thereby constitute said source.

6. A vibration isolating mount for use in high temperature environments comprising:

an inner annular element adapted to be secured to a source of radiant energy and having an axial face directed toward the source;

an intermediate annular element having a face facing, but axially spaced from, said inner element axial face, said intermediate element further including radial projections extending radially outwardly of the periphery of said inner element;

an outer element radially outwardly of said inner element and having portions aligned with said projections each said portion having a face directed toward but axially spaced from said intermediate element face;

first elastomeric pads between and secured to said inner and intermediate element faces; and second elastomeric pads between and secured to said intermediate and outer element faces.

7. A vibration isolating mount for use in high temperature environments comprising:

an inner annular element adapted to be secured to a source of radiant energy and having an axial face directed toward the source;

an intermediate annular element having a face facing, but axially spaced from said inner element axial face, said intermediate element further including radial projections extending radially outwardly of the periphery of said inner elements;

an outer element radially outwardly of said inner element and having portions aligned with said projections each said portion having a face directed toward but axially spaced from said intermediate element face;

first elastomeric pads between and secured to said inner and intermediate element faces;

second elastomeric pads between and secured to said intermediate and outer element faces;

a radially outwardly opening groove on said inner element freely receiving a radially inner edge of said intermediate element; and a radially inwardly opening groove in each of said portions of said outer element and freely receiving the radially outer edge of a corresponding one of said projection.

8. The vibration isolating mount of claim 7 wherein said grooves are lined with an elastomeric material.

9. The vibration isolating mount of claim 8 wherein said grooves have bottom walls and opposed side walls, said side walls serving to arrest axial movement and said bottom walls serving to arrest radial movement.

* * * * *